US011584402B2

(12) United States Patent
Narita et al.

(10) Patent No.: US 11,584,402 B2
(45) Date of Patent: Feb. 21, 2023

(54) RAILCAR BOGIE

(71) Applicant: KAWASAKI RAILCAR MANUFACTURING CO., LTD., Hyogo (JP)

(72) Inventors: Tomohiro Narita, Nishinomiya (JP); Kazuo Isomura, Kobe (JP); Takaya Ono, Kobe (JP)

(73) Assignee: KAWASAKI RAILCAR MANUFACTURING CO., LTD., Kobeshi (JP)

( * ) Notice: Subject to any disclaimer, the term of this patent is extended or adjusted under 35 U.S.C. 154(b) by 384 days.

(21) Appl. No.: 16/910,302

(22) Filed: Jun. 24, 2020

(65) Prior Publication Data

US 2020/0317233 A1 Oct. 8, 2020

Related U.S. Application Data

(63) Continuation of application No. PCT/JP2018/046571, filed on Dec. 18, 2018.

(30) Foreign Application Priority Data

Dec. 26, 2017 (JP) ..... JP2017-248982

(51) Int. Cl.
*B61F 5/30* (2006.01)
*B61F 5/52* (2006.01)
*B61F 5/00* (2006.01)

(52) U.S. Cl.
CPC ..... *B61F 5/302* (2013.01); *B61F 5/00* (2013.01); *B61F 5/30* (2013.01); *B61F 5/52* (2013.01)

(58) Field of Classification Search
CPC ..... B61F 3/02; B61F 3/04; B61F 5/00; B61F 5/06; B61F 5/12; B61F 5/122;
(Continued)

(56) References Cited

U.S. PATENT DOCUMENTS

2014/0137765 A1* 5/2014 Nishimura ..... B61F 5/52 105/182.1
2014/0144347 A1* 5/2014 Nishimura ..... B61F 5/52 105/197.05

(Continued)

FOREIGN PATENT DOCUMENTS

CN 107161167 A * 9/2017 ..... B61F 5/06
JP 2012-116279 A 6/2012

(Continued)

*Primary Examiner* — S. Joseph Morano
*Assistant Examiner* — Cheng Lin
(74) *Attorney, Agent, or Firm* — Xsensus LLP

(57) ABSTRACT

A railcar bogie includes a bogie frame including a cross beam and supports, the supports disposed at respective car width direction end portions of the cross beam. There are a plurality of axle boxes to accommodate a plurality of bearings supporting a pair of axles, a plate spring extending in a car longitudinal direction and supported by a pair of the axle boxes which are away from each other in the car longitudinal direction among the plurality of axle boxes. The plate spring supports the cross beam while being pressed by the corresponding support from above such that the pressing member is separable from the plate spring. Elastic walls are at both respective sides of the supports in the car longitudinal direction and sandwiched between a lower surface of the bogie frame and an upper surface of the plate spring so as to be compressed.

9 Claims, 7 Drawing Sheets

(58) Field of Classification Search
CPC .... B61F 5/125; B61F 5/24; B61F 5/26; B61F 5/30; B61F 5/32; B61F 5/40; B61F 5/50; B61F 5/52; B61F 5/302
See application file for complete search history.

(56) References Cited

U.S. PATENT DOCUMENTS

| | | | | |
|---|---|---|---|---|
| 2015/0344047 | A1* | 12/2015 | Nishimura | B61C 9/50<br>105/197.05 |
| 2016/0251023 | A1 | 9/2016 | Nishimura et al. | |

FOREIGN PATENT DOCUMENTS

| | | | |
|---|---|---|---|
| JP | 5878992 | B2 | 3/2016 |
| WO | 2014/203450 | A1 | 12/2014 |

* cited by examiner

RAILCAR BOGIE

CROSS-REFERENCE TO RELATED APPLICATIONS

The present application is a bypass continuation of PCT filing PCT/JP2018/046571, filed Dec. 18, 2018, which claims priority to JP 2017-248982, filed Dec. 26, 2017, the entire contents of each are incorporated herein by reference.

TECHNICAL FIELD

The present invention relates to a railcar bogie including a plate spring.

BACKGROUND ART

PTL 1 discloses a railcar bogie in which side sills are omitted from a bogie frame and plate springs are included. Also, pressing members of the bogie frame are separably placed on respective middle upper surfaces of the plate springs. In this bogie, gaps are formed at both respective car longitudinal direction sides of a contact point between the plate spring and the pressing member. Further, since the plate spring is not fixed to the pressing member, the gaps between the plate spring and the pressing member may widen during traveling of a car. In order to prevent foreign matter from entering the gaps, a flexible cover is attached.

CITATION LIST

Patent Literature

PTL 1: Japanese Patent No. 5878992

SUMMARY OF INVENTION

However, according to the configuration of PTL 1, structures for attaching the flexible cover to the bogie frame, attaching work, and the like are complex, and this increases cost.

A railcar bogie according to one aspect of the present invention includes a bogie frame including a cross beam and pressing members or supports, the pressing members or supports being provided at both respective car width direction end portions of the cross beam; a plurality of axle boxes configured to accommodate a plurality of bearings supporting a pair of axles. There is a plate spring extending in a car longitudinal direction and supported by a pair of axle boxes arranged away from each other in the car longitudinal direction among the plurality of axle boxes, the plate spring supporting the cross beam while being pressed by the corresponding pressing member from above such that the pressing member is separable from the plate spring. There are elastic walls at both respective sides of the pressing member or supports in the car longitudinal direction and sandwiched between a lower surface of the bogie frame and an upper surface of the plate spring so as to be compressed.

According to the above configuration, the elastic wall members arranged at both respective car longitudinal direction sides of a contact region between the pressing member and the plate spring closes a space between the bogie frame and the plate spring from outside in the car longitudinal direction. Therefore, foreign matter can be prevented from entering a gap between the plate spring and the pressing member from the car longitudinal direction. Further, even when the gap between the plate spring and the pressing member widens during traveling of the car, foreign matter can be prevented from entering the gap. In addition, since the elastic wall members are compressed by utilizing the lower surface of the bogie frame, such configuration is simple, and bogie assembling work is easily performed. Therefore, foreign matter can be prevented from entering the gap between the plate spring and the pressing member at a low cost.

According to the present invention, foreign matter are prevented from entering a gap between a plate spring and a pressing member at a low cost.

DESCRIPTION OF EMBODIMENTS

Hereinafter, an embodiment will be described with reference to the drawings. In the following description, a direction in which a railcar travels and a car body extends is defined as a car longitudinal direction, and a lateral direction perpendicular to the car longitudinal direction is defined as a car width direction. The car longitudinal direction is also referred to as a front-rear direction, and the car width direction is also referred to as a left-right direction.

Figure 1:
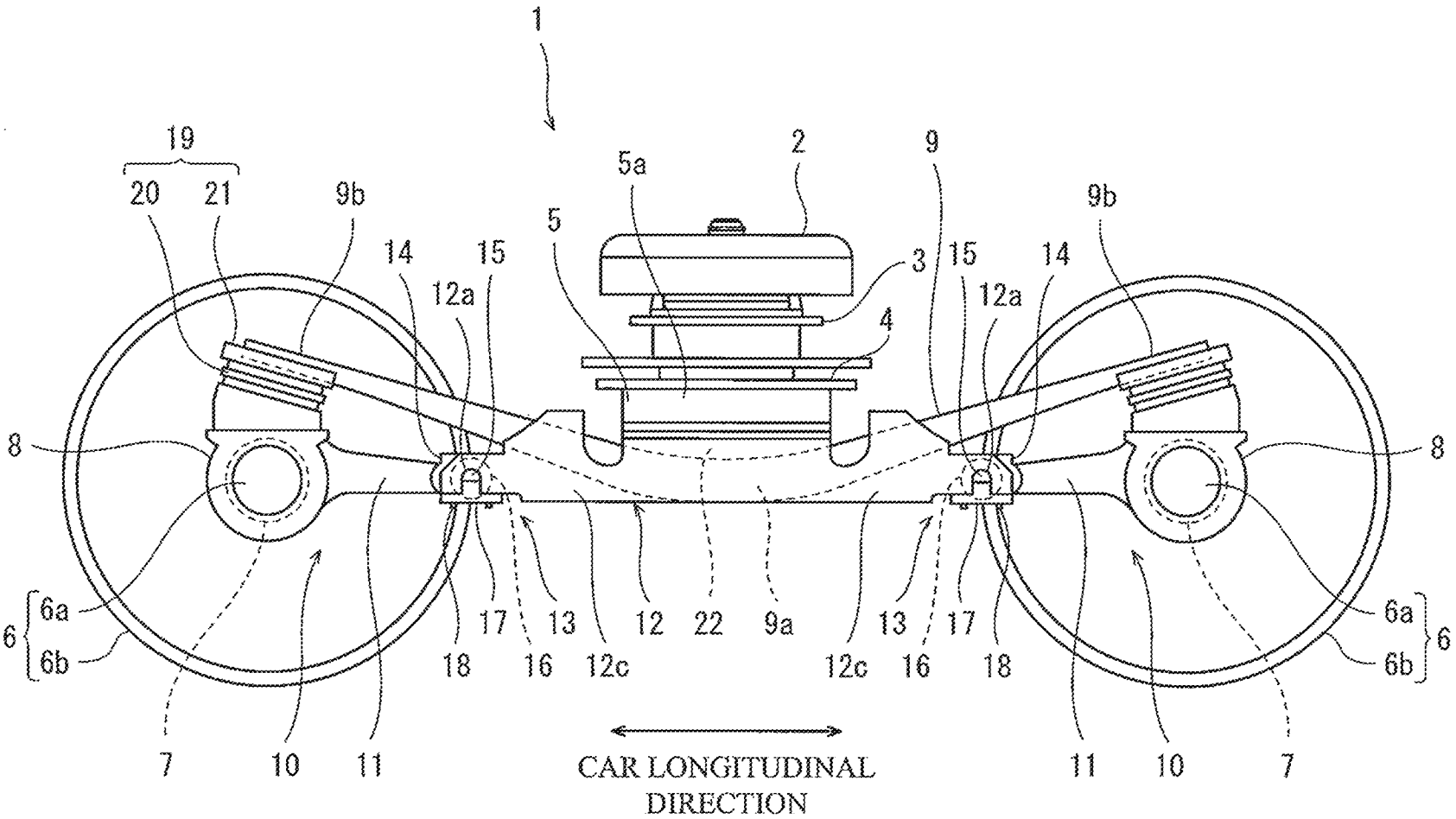
FIG. 1 is a side view showing a railcar bogie according to an embodiment when viewed from a car width direction.

FIG. 1 is a side view showing a railcar bogie 1 according to the embodiment when viewed from the car width direction. As shown in FIG. 1, the railcar bogie 1 includes a bogie frame 4 supporting a car body through an air spring 2 (secondary suspension) and a bolster 3. The bogie frame 4 includes a cross beam 5 but does not include so-called side sills. The cross beam 5 is located at a car longitudinal direction middle of the bogie 1 and extends in the car width direction. It should be noted that the bogie 1 of the present embodiment is a bolster-equipped bogie but may be a bolsterless bogie.

The cross beam 5 is connected to the bolster 3 so as to be turnable relative to the bolster 3. The bolster 3 is connected to the car body through the air spring 2 and a bolster anchor. A pair of wheelsets 6 are arranged at both sides of the cross beam 5 in the car longitudinal direction. Each of the wheelsets 6 includes: an axle 6*a* extending in the car width direction; and wheels 6*b* provided at both respective sides of the axle 6*a* in the car width direction. Both car width direction side portions of the axle 6*a* are rotatably supported by respective bearings 7, and the bearings 7 are accommodated in respective axle boxes 8.

The axle boxes 8 support respective end portions 9*b* of plate springs 9 each extending in the car longitudinal direction. Longitudinal direction middle portions 9*a* of the plate springs 9 support respective car width direction end portions 5*a* of the cross beam 5. To be specific, each of the plate springs 9 is supported by a pair of axle boxes 8 arranged away from each other in the car longitudinal direction at each of both sides of the bogie 1 in the car width direction and supports the bogie frame 4. Therefore, the plate spring 9 has both the function of a primary suspension and the function of a conventional side sill. For example, the plate spring 9 is made of fiber-reinforced resin. The plate spring 9 has a bow shape that is convex downward as a whole in a side view of the bogie. To be specific, the middle portion 9*a* of the plate spring 9 is located lower than the end portions 9*b* of the plate spring 9.

The axle boxes 8 are coupled to the car width direction end portions 5*a* of the cross beam 5 by coupling mechanisms 10 that are axle box suspensions. Each of the coupling mechanisms 10 includes an axle beam 11, a receiving beam 12, and a coupling portion 13. The axle beam 11 projects integrally from the axle box 8 toward the cross beam 5 (i.e., toward a bogie middle side). The receiving beam 12 projects toward the axle beam 11 from the cross beam 5 side. The coupling portion 13 couples a tip end portion of the axle beam 11 to the receiving beam 12. To be specific, the coupling mechanism 10 is of an axle beam type as one example but is not limited to this. The plate spring 9 extends through a space to reach a position under the cross beam 5, the space being formed by the receiving beam 12 having an inverted concave shape when viewed from the car longitudinal direction. To be specific, the middle portion 9*a* of the plate spring 9 is arranged at a position overlapping the receiving beam 12 in a side view.

For example, the coupling portion 13 includes: a tubular portion 14 provided at a tip end portion of the axle beam 11; a core rod 15 inserted into the tubular portion 14; an elastic bushing 16 (for example, a rubber bushing) interposed between the tubular portion 14 and the core rod 15; fitting grooves 12*a* formed at the receiving beam 12; a lid member 17; and fasteners 18. An inner peripheral surface of the tubular portion 14 has a cylindrical shape, and both lateral direction sides of the tubular portion 14 are open. The elastic bushing 16 and the core rod 15 are inserted into an internal space of the tubular portion 14. The fitting grooves 12*a* of the receiving beam 12 are open downward, and both lateral direction end portions of the core rod 15 are fitted into the fitting grooves 12*a* from below. In this state, the lid member 17 is fixed to the receiving beam 12 by the fasteners 18 from below so as to close the lower openings of the fitting grooves 12*a*. The core rod 15 is supported by the lid member 17 from below.

Spring seats 19 are attached to respective upper portions of the axle boxes 8. The end portions 9*b* of the plate springs 9 extending in the car longitudinal direction are separably placed on the respective spring seats 19 from above. To be specific, both longitudinal direction end portions 9*b* of the plate springs 9 are supported by the respective axle boxes 8 through the respective spring seats 19. Each of the spring seats 19 includes an elastic body 20 (such as a multi-layer rubber) and a receiving member 21. The elastic body 20 is positioned on an upper surface of the axle box 8. The receiving member 21 is positioned on the elastic body 20, and the end portion 9*b* of the plate spring 9 is placed on the receiving member 21. The plate spring 9 is not fixed to the receiving member 21.

Figure 2:
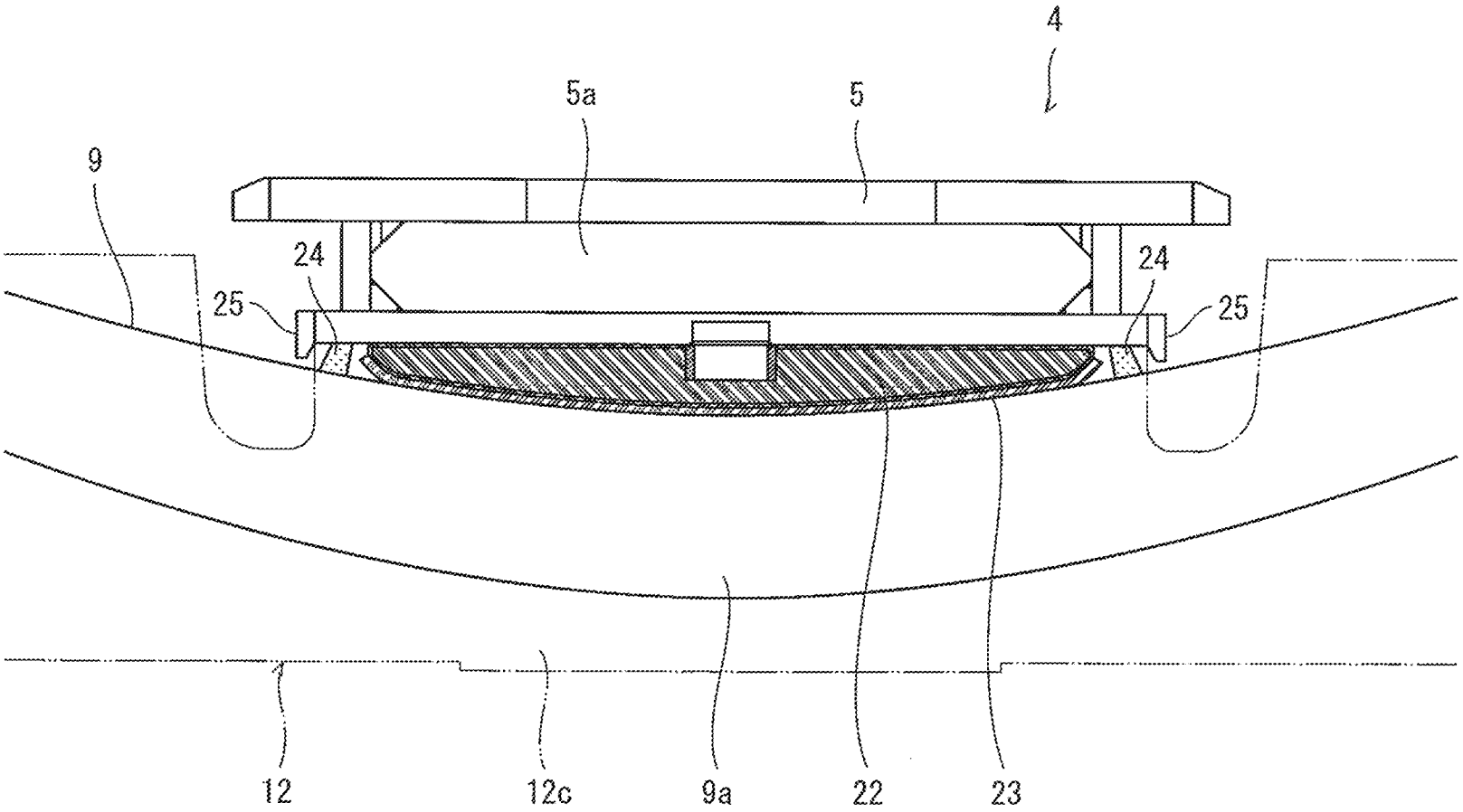
FIG. 2 is a side view showing a plate spring, a pressing member, elastic wall members, and the like in the bogie of FIG. 1 when viewed from the car width direction.

FIG. 2 is a side view showing the plate spring 9, a pressing member or support 22, elastic wall members or elastic walls 24 (also considered to be a means for separating), and the like in the bogie 1 of FIG. 1 when viewed from the car width direction. As shown in FIGS. 1 and 2, the bogie frame 4 includes the pressing member 22 provided at a lower portion of the end portion 5*a* of the cross beam 5. For example, the pressing member 22 or support is constituted by or includes a non-elastic member made of metal, fiber-reinforced resin, or the like, and a buffer sheet 23 (for example, a rubber sheet) is provided on a lower surface of the pressing member 22. For example, the pressing member 22 is attached to a lower surface of the end portion 5*a* of the cross beam 5 by recess-projection fitting. However, the pressing member 22 may be fixed to the end portion 5*a* of the cross beam 5 by welding or the like. The middle portion 9*a* of the plate spring 9 is located right under the pressing member 22. An upper surface of the middle portion 9*a* has a circular-arc shape that is convex downward in a side view of the bogie. The lower surface of the pressing member 22 has a circular-arc shape that is convex downward in a side view of the bogie. The pressing member 22 is placed on the middle portion 9*a* of the plate spring 9 from above.

The pressing member 22 presses the upper surface of the plate spring 9 by gravitational downward load from the cross beam 5 so as to be separable from the upper surface of the plate spring 9 without being fixed to the plate spring 9. To be specific, the pressing member 22 presses the upper surface of the plate spring 9 without being connected to the plate spring 9 by fixtures (for example, bolts). To be specific, the pressing of the pressing member 22 against the upper surface of the plate spring 9 is maintained by the gravitational downward load from the cross beam 5 and its reaction force of the plate spring 9. With this, the plate spring 9 can swing while changing a region pressed against the lower surface of the pressing member 22. The pressing member 22 may be directly placed on the upper surface of the middle portion 9*a* of the plate spring 9 or may be indirectly placed on the upper surface of the middle portion 9*a* of the plate spring 9.

When the bogie 1 is not supporting the car body, a curvature of the lower surface of the pressing member 22 is larger than a curvature of the upper surface of the middle portion 9*a* of the plate spring 9. When the bogie 1 is supporting the car body, the plate spring 9 elastically deforms by the downward load from the car body such that the cross beam 5 sinks downward, and therefore, the curvature of the middle portion 9*a* of the plate spring 9 increases. Gaps are formed between the plate spring 9 and the pressing member 22 by the difference between the curvature of the plate spring 9 and the curvature of the pressing member 22. When the cross beam 5 and the plate spring 9 turn relative to each other in a pitching direction by acceleration or deceleration of the car, vertical vibration of the wheelsets 6, and the like, the pressing member 22 turns while changing a region pressed against the upper surface of the middle portion 9*a* of the plate spring 9. Therefore, the gap formed between the lower surface of the longitudinal direction end portion of the pressing member 22 and the upper surface of the plate spring 9 may increase.

In the present embodiment, in order to prevent foreign matter from entering the gaps, the elastic wall members or elastic walls 24 are provided at both respective sides of the pressing member 22 in the car longitudinal direction. Thus, the elastic wall members or elastic walls 24 perform the function of separating and are therefore a means for separating. In the present embodiment, the entire elastic wall members 24 are arranged outside the pressing member 22 in the car longitudinal direction, and the elastic wall members 24 and the pressing member 22 are spaced apart from each other. The elastic wall members 24 are sandwiched between the lower surface of the bogie frame 4 and the upper surface of the plate spring 9 so as to be compressed. Specifically, a length of the pressing member 22 in the car longitudinal direction is smaller than a length of the lower surface of the end portion 5*a* of the cross beam 5 in the car longitudinal direction, and both car longitudinal direction ends of the pressing member 22 are arranged inside both car longitudinal direction ends of the lower surface of the end portion 5*a* of the cross beam 5 in the car longitudinal direction. The elastic wall members 24 are located at both respective sides of the pressing member 22 in the car longitudinal direction and sandwiched between the lower surface of the end portion 5*a* of the cross beam 5 and the upper surface of the plate spring 9.

In the present embodiment, the elastic wall members 24 are adhered to the upper surface of the plate spring 9 and contact the lower surface of the end portion 5*a* of the cross beam 5 without being adhered to the lower surface of the end portion 5*a* of the cross beam 5. It should be noted that upper and lower surfaces of each elastic wall member 24 may be respectively adhered to the cross beam 5 and the plate spring 9, or each elastic wall member 24 may be adhered to the lower surface of the cross beam 5 and contact the upper surface of the plate spring 9 without being adhered to the upper surface of the plate spring 9.

Protruding portions 25, also referred to as protrusions, are provided at each end portion 5*a* of the cross beam 5. The protruding portions 25 are located outside the elastic wall member 24 in the car longitudinal direction and project downward. When viewed from the car longitudinal direction, lower ends of the protruding portions 25 are located lower than a boundary between the upper surface of the elastic wall member 24 and the lower surface of the end portion 5*a* of the cross beam 5 and are spaced apart from the upper surface of the plate spring 9. A length of the protruding portion 25 in the car width direction is equal to or larger than a length of the pressing member 22 in the car width direction. The protruding portion 25 is spaced apart from the elastic wall member 24 in the car longitudinal direction.

Figure 3:
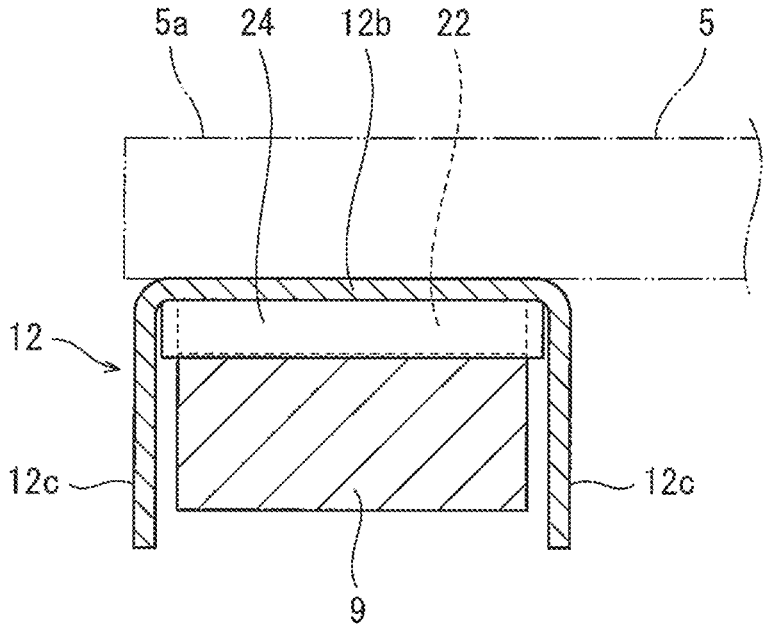
FIG. 3 is a sectional view showing the plate spring, receiving seat portions, the elastic wall member, and the like shown in FIG. 2 when viewed from a car longitudinal direction.

FIG. 3 is a sectional view showing the plate spring 9, the receiving beam 12, the elastic wall member 24, and the like shown in FIG. 2 when viewed from the car longitudinal direction. As shown in FIGS. 1 and 3, the receiving beam 12 includes an upper wall portion 12*b* and a pair of receiving seat portions 12*c*, also referred to as receiving seats, and has an inverted concave shape when viewed from the car longitudinal direction. The receiving seat portions 12*c* project downward from both respective car width direction ends of the upper wall portion 12*b*. The receiving seat portions 12*c* project in the car longitudinal direction beyond the upper wall portion 12*b*. The fitting grooves 12*a* are formed at respective projecting tip end portions of the receiving seat portions 12*c* so as to be concave from a lower side to an upper side (see FIG. 1). The receiving seat portions 12*c* are arranged at both respective sides of the pressing member 22 in the car width direction. When viewed from the car width direction, the receiving seat portions 12*c* cover a gap between the elastic wall member 24 and the pressing member 22 from a lateral side (see FIG. 2).

As shown in FIG. 3, the receiving seat portions 12*c* are spaced apart from the plate spring 9 in the car width direction. The elastic wall member 24 has a shape extending in the car width direction. The elastic wall member 24 projects in the car width direction toward the receiving seat portions 12*c* beyond the plate spring 9. Car width direction end surfaces of the elastic wall member 24 may contact the receiving seat portions 12*c* or may be slightly spaced apart from the receiving seat portions 12*c*. It should be noted that parts of the elastic wall member 24 which parts project in the car width direction beyond the plate spring 9 may project downward toward respective gaps each between the plate spring 9 and the receiving seat portion 12*c*. The elastic wall member 24 is not required to project in the car width direction beyond the plate spring 9.

Figure 4:
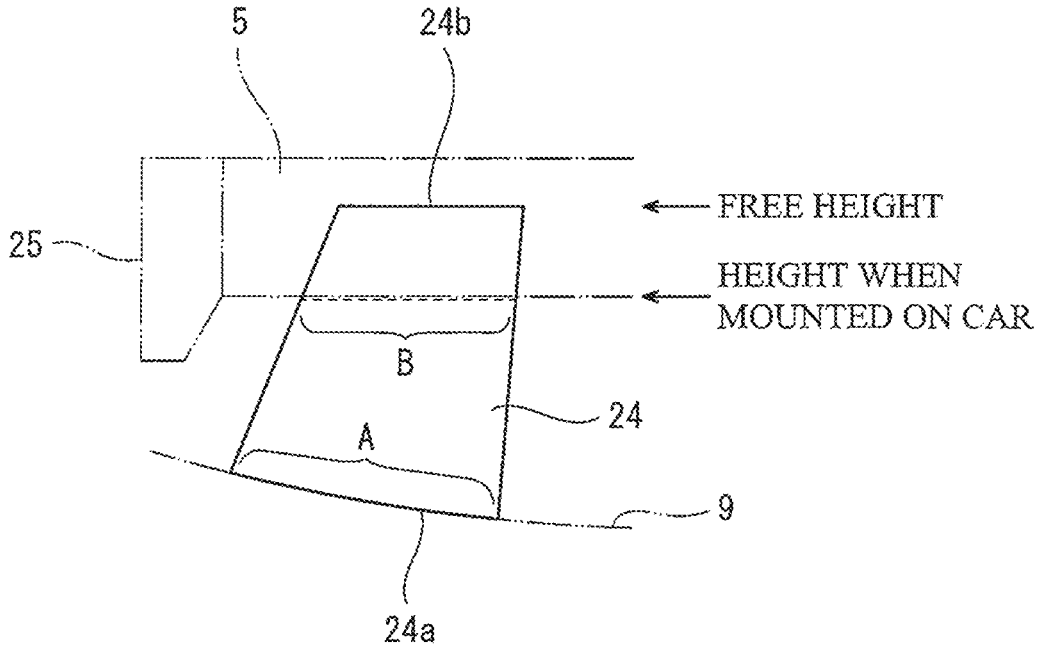
FIG. 4 is a side view showing the elastic wall member of FIG. 2 when viewed from the car width direction.

FIG. 4 is a side view showing the elastic wall member 24 of FIG. 2 when viewed from the car width direction. As shown in FIG. 4, in a side view when viewed from the car width direction, the elastic wall member 24 has such a shape that the upper surface thereof is smaller than the lower surface thereof. Specifically, when viewed from the car width direction, the elastic wall member 24 has a substantially trapezoidal shape. As one example, the elastic wall member 24 is made of closed cell type porous material. When viewed from the car width direction, a first surface region A of the plate spring 9 is inclined relative to a second surface region B of the cross beam 5. The first surface region A of the plate spring 9 supports a lower surface 24*a* of the elastic wall member 24, and the second surface region B of the cross beam 5 presses an upper surface 24*b* of the elastic wall member 24. The lower surface 24*a* of the elastic wall member 24 is parallel to the first surface region A of the upper surface of the plate spring 9, and the upper surface 24*b* of the elastic wall member 24 is parallel to the second surface region B of the lower surface of the cross beam 5. Therefore, with the elastic wall member 24 mounted on the bogie 1, the elastic wall member 24 is pressed by the lower surface of the cross beam 5 as uniformly as possible. To be specific, the elastic wall member 24 has a substantially trapezoidal shape in which the upper surface thereof is smaller than the lower surface thereof in a side view when viewed from the car width direction. Even in this case, with the elastic wall member 24 mounted on the bogie 1, the elastic wall member 24 is pressed by the lower surface of the cross beam 5 as uniformly as possible as long as the first surface region A and the lower surface 24*a* of the elastic wall member 24 are parallel to each other, and the second surface region B and the upper surface 24*b* of the elastic wall member 24 are parallel to each other.

According to the above-described configuration, the elastic wall members 24 arranged at both respective car longitudinal direction sides of a contact region between the pressing member 22 and the plate spring 9 closes a space between the cross beam 5 and the plate spring 9 from outside in the car longitudinal direction. Therefore, foreign matter can be prevented from entering the gap between the plate spring 9 and the pressing member 22 from the car longitudinal direction. In addition, since the elastic wall members 24 are compressed by utilizing the lower surface of the cross beam 5, such configuration is simple, and bogie assembling work is easily performed. Therefore, foreign matter can be prevented from entering the gap between the plate spring 9 and the pressing member 22 at a low cost. Further, since the elastic wall member 24 includes closed cell type elastic porous material (for example, sponge), the elastic wall member 24 can suitably achieve both the performance of satisfactorily blocking foreign matter and the performance of flexibly following the movements of the cross beam 5 and the plate spring 9.

The elastic wall member 24 projects in the car width direction toward the receiving seat portions 12*c* beyond the plate spring 9, i.e., the elastic wall member 24 protrudes in the car width direction beyond the plate spring 9. Therefore, foreign matter can be more suitably prevented from entering the gap from outside in the car longitudinal direction. Further, since the receiving seat portions 12*c* of the coupling mechanism 10 cover the gap between the elastic wall member 24 and the pressing member 22 from the lateral side, foreign matter can be prevented from entering the gap between the plate spring 9 and the pressing member 22 from both the car longitudinal direction and the car width direction by the elastic wall member 24 and the receiving seat portions 12*c*.

Further, since the elastic wall member 24 is adhered to the upper surface of the plate spring 9 and just contacts the lower surface of the cross beam 5 without being adhered to the lower surface of the cross beam 5, bogie assembling work can be easily performed. Further, the lower surface of the elastic wall member 24 is parallel to the first surface region A of the upper surface of the plate spring 9, and the upper surface of the elastic wall member 24 is parallel to the second surface region B of the lower surface of the end portion 5*a* of the cross beam 5. Therefore, even when the surfaces sandwiching the elastic wall member 24 are not parallel to each other, biased force is prevented from acting on the elastic wall member 24 from the cross beam 5 and the plate spring 9. On this account, shear force is prevented from acting on an adhesion layer between the elastic wall member 24 and the plate spring 9, and positional deviation and peeling of the elastic wall member 24 can be prevented.

Figure 5:
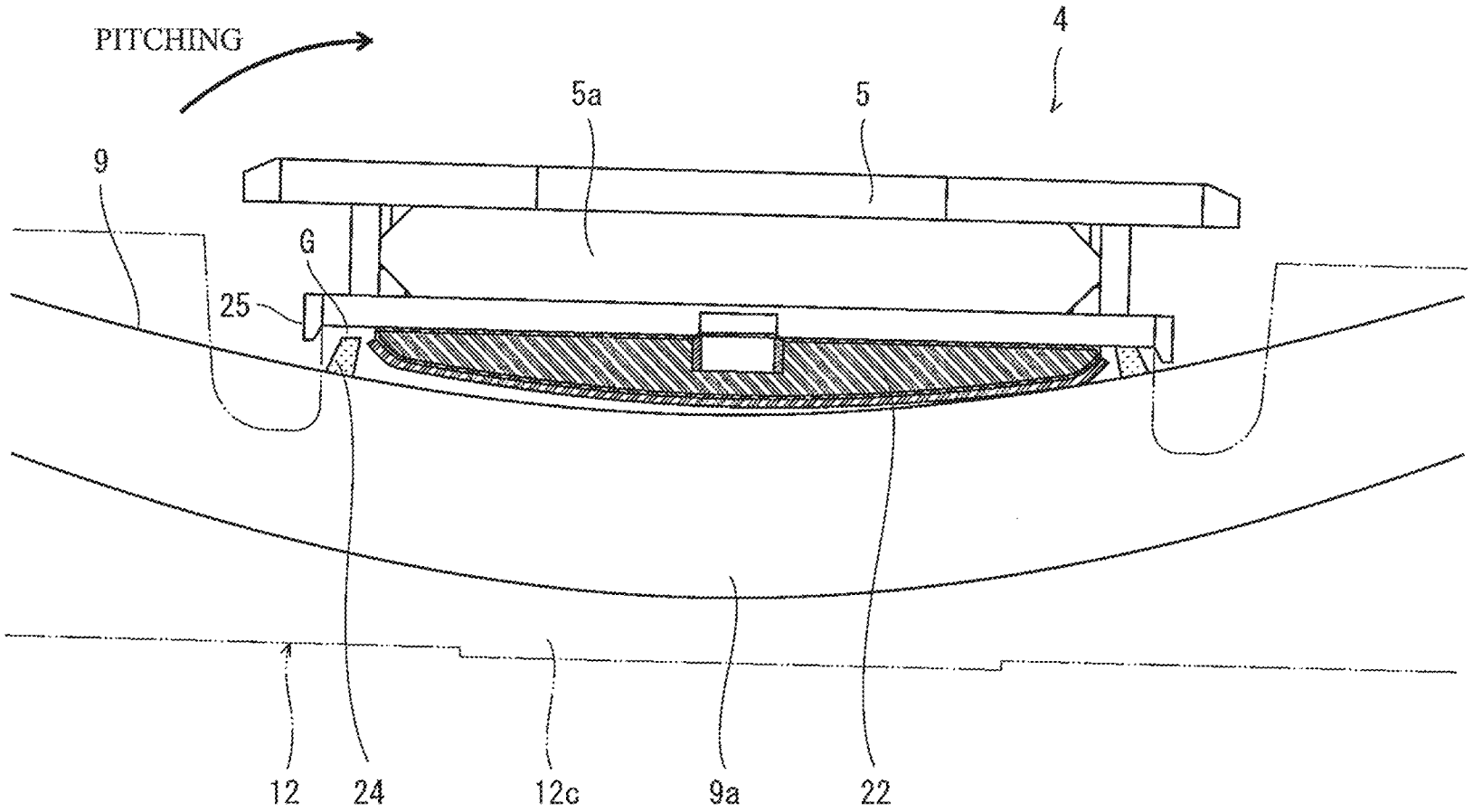
FIG. 5 is a side view for explaining a pitching operation of a cross beam of the bogie shown in FIG. 2.

As shown in FIG. 5, when the cross beam 5 pitches, one of front and rear ends of the cross beam 5 is displaced upward relative to the other of the front and rear ends of the cross beam 5, and this changes a distance between the cross beam 5 and the upper surface of the plate spring 9. In this case, when the elastic wall member 24 just contacts the cross beam 5 without being adhered to the cross beam 5, a gap G may be formed between the upper surface of the elastic wall member 24 and the lower surface of the end portion 5*a* of the cross beam 5. However, the cross beam 5 is provided with the protruding portions 25 located outside the respective elastic wall members 24 in the car longitudinal direction and projecting downward, and the gap G is covered by the protruding portion 25 when viewed from the car longitudinal direction. Therefore, foreign matter can be prevented from entering the gap G by the labyrinth effect.

Figure 6:
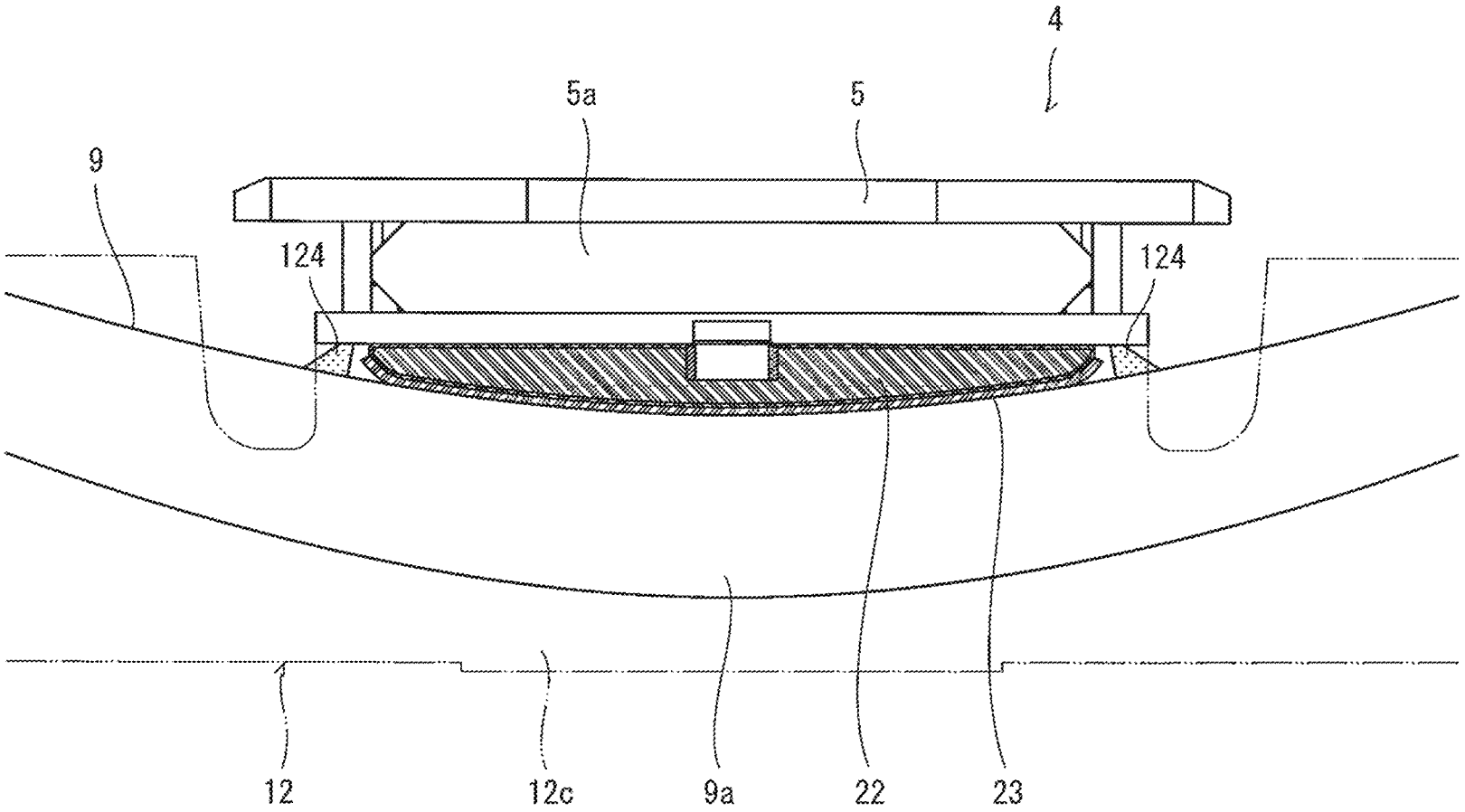
FIG. 6 is a diagram showing the bogie including the elastic wall members according to Modified Example 1 and corresponds to the view of FIG. 2.
Figure 7:
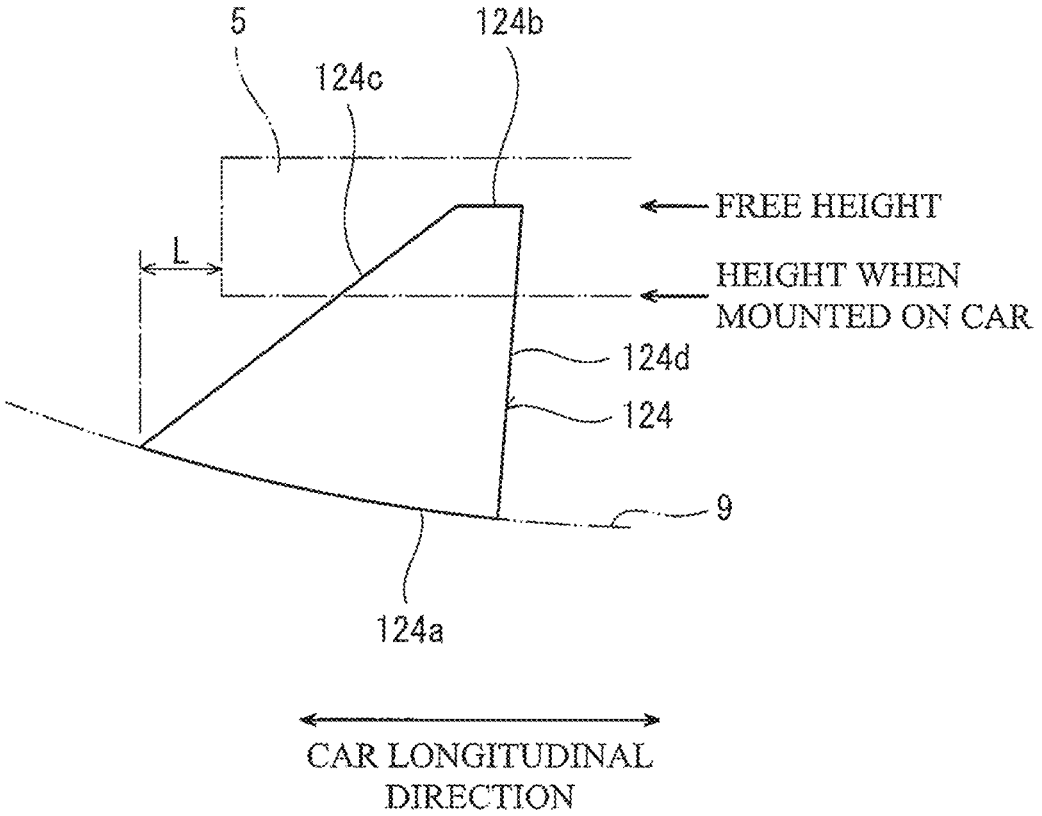
FIG. 7 is a side view showing the elastic wall member of FIG. 6 when viewed from the car width direction.

FIG. 6 is a diagram showing the bogie including elastic wall members 124 according to Modified Example 1 and corresponds to the view of FIG. 2. FIG. 7 is a side view showing the elastic wall member 124 of FIG. 6 when viewed from the car width direction. As shown in FIGS. 6 and 7, the elastic wall member 124 has such a shape that a lower surface 124*a* thereof is larger than an upper surface 124*b* thereof when viewed from the car width direction.

A car longitudinal direction outside end edge of the lower surface 124*a* of the elastic wall member 124 is located outside a car longitudinal direction outside end edge of the lower surface of the cross beam 5 in the car longitudinal direction by a distance L. Therefore, an adhered area between the lower surface 124*a* of the elastic wall member 124 and the plate spring 9 becomes large. On this account, adhesive force between the elastic wall member 124 and the plate spring 9 improves, and positional deviation, peeling, and the like of the elastic wall member 124 can be prevented.

The elastic wall member 124 has a shape that tapers upward. The upper surface 124*b* of the elastic wall member 124 is located at an inner side relative to the lower surface 124*a* of the elastic wall member 124 in the car longitudinal direction. To be specific, the inclination of a car longitudinal direction outside surface 124*c* of the elastic wall member 124 relative to the vertical direction is larger than the inclination of a car longitudinal direction inside surface 124*d* of the elastic wall member 124 relative to the vertical direction. Therefore, regardless of when the car is empty or full with the car body mounted on the bogie, a car longitudinal direction outside edge of the lower surface of the cross beam 5 does not contact the elastic wall member 124, and therefore, the elastic wall member 124 is prevented from being damaged.

Figure 8:
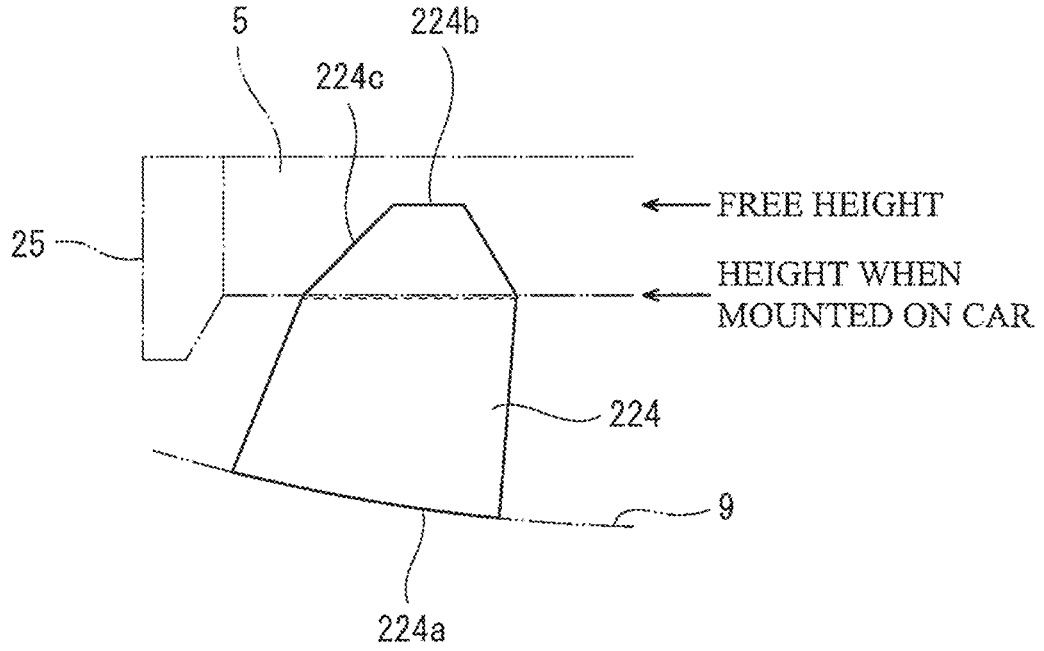
FIG. 8 is a side view showing the elastic wall member according to Modified Example 2 when viewed from the car width direction.

When viewed from the car width direction, the lower surface 124*a* of the elastic wall member 124 is parallel to the upper surface of the plate spring 9, and the upper surface 124*b* of the elastic wall member 124 is parallel to the second surface region B of the lower surface of the cross beam 5. To be specific, the upper surface 124*b* of the elastic wall member 124 is inclined relative to the lower surface 124*a* of the elastic wall member 124. The upper surface 124*b* of the elastic wall member 124 is parallel to the second surface region B of the lower surface of the cross beam 5, and the inclination of the car longitudinal direction outside surface 124*c* of the elastic wall member 124 is large. Therefore, when the elastic wall member 124 is compressed with the car body mounted on the bogie, the contact area between the elastic wall member 124 and the lower surface of the cross beam 5 becomes large. Therefore, while preventing the increase in the adhered area between the lower surface 124*a* of the elastic wall member 124 and the plate spring 9 and the damage of the elastic wall member 124 by the car longitudinal direction outside edge, dust and the like are prevented from entering through between the upper surface 124*b* of the elastic wall member 124 and the lower surface of the cross beam 5 toward the pressing member 22. Since the other components are the same as those of Embodiment 1, FIG. 8 is a side view showing an elastic wall member 224 according to Modified Example 2 when viewed from the car width direction. As shown in FIG. 8, the elastic wall member 224 has such a shape that an upper surface 224*b* thereof is smaller than a lower surface 224*a* thereof when viewed from the car width direction. Specifically, a tapered cutout portion 224*c*, also referred to as a cutout, is formed at an upper portion of the elastic wall member 224. To be specific, an upper portion of the elastic wall member 224 which portion is crushed by the lower surface of the cross beam 5 is formed in a tapered shape in the vertical direction i.e., is thinner than a lower portion of the elastic wall member 224 such that the volume of the upper portion of the elastic wall member 224 becomes small. According to this, even when the surfaces sandwiching the elastic wall member 224 are not parallel to each other, stress generated at the elastic wall member 224 is suppressed, and positional deviation, peeling, and the like of the elastic wall member 224 can be prevented.

Figure 9:
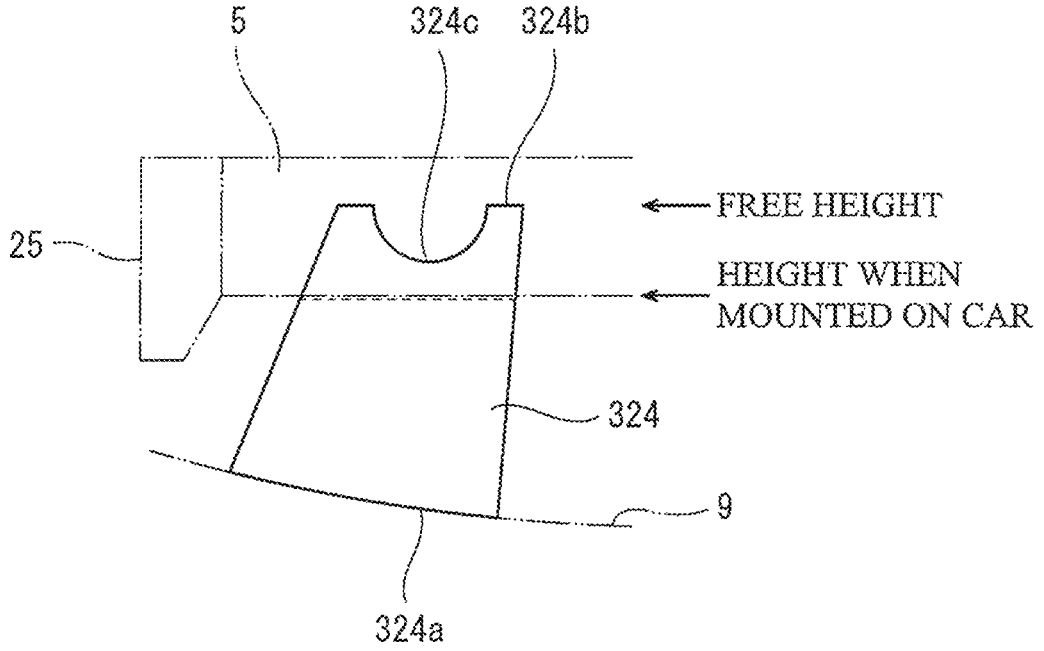
FIG. 9 is a side view showing the elastic wall member according to Modified Example 3 when viewed from the car width direction.

FIG. 9 is a side view showing an elastic wall member 324 according to Modified Example 3 when viewed in the car width direction. As shown in FIG. 9, the elastic wall member 324 has such a shape that an upper surface 324*b* thereof is smaller than a lower surface 324*a* thereof when viewed from the car width direction. Specifically, a concave cutout portion 324*c* is formed on the upper surface 324*b* of the elastic wall member 324. According to this, the volume of an upper portion of the elastic wall member 324 which portion is crushed by the lower surface of the cross beam 5 becomes small. Therefore, even when the surfaces sandwiching the elastic wall member 324 are not parallel to each other, stress generated at the elastic wall member 324 is suppressed, and positional deviation of the elastic wall member 324 can be prevented.

The present invention is not limited to the above-described embodiment and the modified examples. Modifications, additions, and eliminations may be made with respect to the configurations of the embodiment and the modified examples. For example, the elastic wall member may be pressed by a lower surface other than the lower surface of the cross beam as long as the lower surface is part of the bogie frame and opposed to the plate spring in the vertical direction. The material of the elastic wall member is not limited to the elastic porous material and may be different elastic material (for example, rubber or silicone). The protruding portions 25 projecting downward may or may not be provided at the end portions 5*a* of the cross beam 5.

REFERENCE SIGNS LIST

1 bogie
4 bogie frame
5 cross beam
5*a* end portion
6*a* axle
7 bearing
8 axle box
9 plate spring
10 coupling device
12*c* receiving seat portion
22 pressing member or support
24, 124, 224, 324 elastic wall member
25 protruding portion
124*c*, 224*c*, 324*c* cutout portion
A first surface region
B second surface region

The invention claimed is:

1. A railcar bogie, comprising:

a bogie frame including a cross beam and supports, the supports at respective car width direction end portions of the cross beam;

a plurality of axle boxes to accommodate a plurality of bearings supporting a pair of axles;

a plate spring extending in a car longitudinal direction and supported by a pair of the axle boxes which are away from each other in the car longitudinal direction, the plate spring supporting the cross beam while being pressed by a corresponding one of the supports from above such that the support is separable from the plate spring; and elastic walls at both respective sides of the support in the car longitudinal direction and sandwiched between a lower surface of the bogie frame and an upper surface of the plate spring so as to be compressed, wherein:

in a side view, a first surface region of the plate spring is inclined relative to a second surface region of the bogie frame, the first surface region supporting a lower surface of the corresponding elastic wall, the second surface region pressing an upper surface of the elastic wall; and the lower surface of the elastic wall is parallel to the first surface region, and the upper surface of the elastic wall is parallel to the second surface region.

2. The railcar bogie according to claim 1, wherein:

the support includes car longitudinal direction ends, the car longitudinal direction ends of the support are inside both car longitudinal direction ends of a lower surface of the cross beam in the car longitudinal direction; and the elastic walls are located at both respective sides of the support in the car longitudinal direction and sandwiched between the lower surface of the cross beam and the upper surface of the plate spring.

3. The railcar bogie according to claim 1, further comprising:

a plurality of couplers to couple the plurality of axle boxes to the bogie frame, wherein:

each of the couplers includes a pair of receiving seats at both respective sides of the support in a car width direction, and the pair of receiving seats cover a gap between the corresponding elastic wall and the support from a lateral side.

4. The railcar bogie according to claim 3, wherein:

the pair of receiving seats are spaced apart from the plate spring in the car width direction; and each of the elastic walls projects in the car width direction toward the receiving seats beyond the plate spring.

5. The railcar bogie according to claim 1, wherein the bogie frame further includes a protrusion located outside the corresponding elastic wall in the car longitudinal direction and projecting downward.

6. A railcar bogie, comprising:

a bogie frame including a cross beam and supports, the supports at respective car width direction end portions of the cross beam;

a plurality of axle boxes to accommodate a plurality of bearings supporting a pair of axles;

a plate spring extending in a car longitudinal direction and supported by a pair of the axle boxes which are away from each other in the car longitudinal direction, the plate spring supporting the cross beam while being pressed by a corresponding one of the supports from above such that the support is separable from the plate spring; and elastic walls at both respective sides of the support in the car longitudinal direction and sandwiched between a lower surface of the bogie frame and an upper surface of the plate spring so as to be compressed, wherein:

in a side view, a surface of the plate spring supporting a lower surface of the corresponding elastic wall is inclined relative to a surface of the bogie frame pressing an upper surface of the elastic wall; and a cutout at an upper or lower portion of the elastic wall.

7. The railcar bogie according to claim 6, wherein the bogie frame further includes a protrusion located outside the corresponding elastic wall in the car longitudinal direction and projecting downward.

8. A railcar bogie, comprising:

a bogie frame including a cross beam and supports, the supports at respective car width direction end portions of the cross beam;

a plurality of axle boxes to accommodate a plurality of bearings supporting a pair of axles;

a plate spring extending in a car longitudinal direction and supported by a pair of the axle boxes which are away from each other in the car longitudinal direction, the plate spring supporting the cross beam while being pressed by a corresponding one of the supports from above such that the support is separable from the plate spring; and elastic walls at both respective sides of the support in the car longitudinal direction and sandwiched between a lower surface of the bogie frame and an upper surface of the plate spring so as to be compressed, wherein the elastic walls are adhered to the upper surface of the plate spring and contact the lower surface of the bogie frame without being adhered to the lower surface of the bogie frame.

9. The railcar bogie according to claim 8, wherein the bogie frame further includes a protrusion located outside the corresponding elastic wall in the car longitudinal direction and projecting downward.

* * * * *